US008800539B2

(12) United States Patent
Toedter et al.

(10) Patent No.: US 8,800,539 B2
(45) Date of Patent: Aug. 12, 2014

(54) METHOD AND SYSTEM FOR IGNITING A FUEL-AIR-MIXTURE OF A COMBUSTION CHAMBER, IN PARTICULAR IN A COMBUSTION ENGINE BY CREATING A CORONA DISCHARGE

(75) Inventors: Olaf Toedter, Walzbachtal (DE); Helmut Mueller, Hessigheim (DE); Gerd Braeuchle, Hueffenhardt (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 440 days.

(21) Appl. No.: 13/254,437

(22) PCT Filed: Mar. 13, 2010

(86) PCT No.: PCT/EP2010/001605

§ 371 (c)(1), (2), (4) Date: Sep. 1, 2011

(87) PCT Pub. No.: WO2010/105784

PCT Pub. Date: Sep. 23, 2010

(65) Prior Publication Data

US 2011/0305998 A1 Dec. 15, 2011

(30) Foreign Application Priority Data

Mar. 16, 2009 (DE) ..... 10 2009 013 877

(51) Int. Cl.

| | |
|---|---|
| ***F02P 9/00*** | (2006.01) |
| ***F02P 23/04*** | (2006.01) |
| ***H01T 19/00*** | (2006.01) |
| ***H01T 19/02*** | (2006.01) |
| ***H01T 19/04*** | (2006.01) |
| *F02D 41/20* | (2006.01) |
| *F02N 19/00* | (2010.01) |

(52) U.S. Cl.

CPC ..... *F02P 9/007* (2013.01); *F02P 23/04* (2013.01); *F02D 2041/2051* (2013.01); *F02N 19/00* (2013.01); *H01T 19/00* (2013.01); *H01T 19/02* (2013.01); *H01T 19/04* (2013.01)

USPC ..... 123/606; 123/608

(58) Field of Classification Search

USPC ..... 123/606, 608, 143 A, 143 B, 162, 536

See application file for complete search history.

(56) References Cited

U.S. PATENT DOCUMENTS 4,920,494 A * 4/1990 Abo et al. ..... 701/104
5,777,216 A * 7/1998 Van Duyne et al. ..... 73/114.67

(Continued)

FOREIGN PATENT DOCUMENTS

DE 10 2006 027204 B3 11/2007
EP 021113 A1 2/1987

(Continued)

OTHER PUBLICATIONS

Hao, L.; Lewin, P.L.; Swingler, S.G.: Identification of Multiple Partial Dis-charge Sources. 2008 Int. Conf. on Cond. Monitoring and Diagnosis, Bei-jing, China, Apr. 21-24, 2008.

(Continued)

*Primary Examiner* — Mahmoud Gimie

(74) *Attorney, Agent, or Firm* — Hackler Daghighian & Martino

(57) ABSTRACT

The invention relates to a method for igniting a fuel/air mixture in one or more combustion chambers which are delimited by walls that are at ground potential, wherein an electric resonant circuit is excited in which an ignition electrode, which is guided through one of the walls delimiting the combustion chamber in an electrically insulated manner and which extends into the combustion chamber, in cooperation with the walls of the combustion chamber that are at ground potential constitutes a capacitance, and in which the excitation of the resonant circuit is controlled such that a corona discharge igniting the fuel/air mixture is created in the combustion chamber at the ignition electrode. The strength of the AC current flowing in the resonant circuit, the AC voltage exciting the resonant circuit and/or the impedance of the resonant circuit are monitored, and the observations or one or more measurement variables derived therefrom and/or the time curve thereof are used to obtain indicators that characterize the state of the combustion chamber and/or the state of the material mixture present in the combustion chamber and are provided for further processing.

22 Claims, 2 Drawing Sheets

(56) References Cited

U.S. PATENT DOCUMENTS

| | | | | |
|---|---|---|---|---|
| 6,883,507 | B2 * | 4/2005 | Freen | 123/606 |
| 2004/0129241 | A1 | 7/2004 | Freen | |
| 2009/0188458 | A1 | 7/2009 | Visser et al. | |
| 2009/0229581 | A1 * | 9/2009 | Ikeda | 123/536 |
| 2010/0005870 | A1 | 1/2010 | Bachmaier et al. | |
| 2010/0251995 | A1 | 10/2010 | Nouvel et al. | |

FOREIGN PATENT DOCUMENTS

| | | | |
|---|---|---|---|
| JP | 2008121462 | A | 5/2008 |
| JP | 2008240547 | A | 10/2008 |
| WO | WO 2004/063560 | A1 | 7/2004 |

OTHER PUBLICATIONS

Tang, Ju; Zhou, Quian; Tang, Ming: Study on Mathematical Model for VHF Partial Discharge of Typical Insulated Defects in GIS, IEEE Transactions on Dielectrics an Electrical Isulation, vol. 14, No. 1; Feb. 2007.

Kim, Jeong-Tae, Choi, Won, Oh, Sung-Kwun, Park, Keon-Jun, Grzybowski: Partial Discharge Pattern Recognition Using Fuzzy-Neural Networks (FNNs) Algorithm; Proceedings of the 2008 IEEE International Power Modulators and High Voltage Conference.

* cited by examiner

METHOD AND SYSTEM FOR IGNITING A FUEL-AIR-MIXTURE OF A COMBUSTION CHAMBER, IN PARTICULAR IN A COMBUSTION ENGINE BY CREATING A CORONA DISCHARGE

The invention is based on a method having the features disclosed herein and on a system disclosed herein. Such a method and such a system are known from WO 2004/063560 A1.

WO 2004/063560 A1 discloses, how a fuel-air-mixture can be ignited in a combustion chamber of a combustion engine by a corona discharge generated in the combustion chamber. For this purpose, an ignition electrode is passed through one of the walls of the combustion chambers in an electrically insulating manner, the walls being applied to ground potential, and projects into the combustion chamber, preferably opposite to a piston provided in the combustion chamber. The ignition electrode forms a capacitance together with the walls of the combustion chamber at earth potential as a counter electrode. The combustion space with its content acts as a dielectric. According to the cycle of the piston, said combustion space contains air or a fuel-air-mixture or an exhaust gas.

The capacitance is part of an electrical resonant circuit, which is energised with a high frequency voltage, which is generated by means of a transformer with centre tap. The transformer co-operates with a switching device, which applies a specifiable D.C. voltage alternately to both primary windings of the transformer, which are separated by the centre tap. The secondary winding of the transformer feeds a series resonant circuit, in which the capacitance formed by the ignition electrode and the walls of the combustion chamber is present. The frequency of the alternate voltage energising the resonant circuit and delivered by the transformer is controlled in such a way, that it is as close as possible to the resonance frequency of the resonant circuit. The result is a voltage overshoot between the ignition electrode and the walls of the combustion chamber, in which the ignition electrode is arranged. The resonance frequency ranges typically between 30 kHz and 3 MHz and the alternate voltage reaches values of for instance 50 kV to 500 kV on the ignition electrode.

In this way a corona discharge can be generated in the combustion chamber. The corona discharge should not turn into an arc discharge or a spark discharge. It is therefore ensured that the voltage between the ignition electrode and the mass remains below the full breakthrough voltage. For this purpose, the mean voltage and the mean amperage are measured at the output of the transformer and the impedance of the resonant circuit is calculated as a quotient from the mean voltage and the mean amperage. The calculated impedance is compared with a setpoint value for the impedance, which is selected in such a way that the corona discharge can be preserved, without causing a complete voltage breakthrough. The current supply of the transformer is operated by a regulator in such a way, for instance by pulse width modulation, that the impedance of the resonant circuit is as close as possible to its setpoint value.

WO 2004/063560 discloses also, how to monitor the high-frequency ignition device for its functionability and to signal any too low voltage or any too high voltage for supplying the resonant circuit and any missing ignition to an engine control device.

SUMMARY OF THE INVENTION

An object of the present invention is to provide an advantageous further development of the method for igniting a fuel-air-mixture in a combustion engine by means of a corona discharge igniting the mixture.

This object is met by a method having the features disclosed herein. A system for igniting a fuel-air-mixture in a combustion engine, which applies the method according to the invention, is disclosed herein. Advantageous refinements of the invention are also described herein.

The method according to the invention is used for igniting a fuel-air-mixture, in particular in a combustion engine, in particular in a piston engine, with one or several combustion chambers, which are delineated by walls, which are at ground potential. The method is particularly suitable for combustion engines in motor vehicles. In such a case, the walls of the combustion chamber are connected to the earth terminal of an accumulator provided in the vehicle.

In the method according to the invention, an electrical resonant circuit is energised, in which a capacitance is present, which is formed by the combination of an electrically insulated ignition electrode extending through one of the walls delineating the combustion chamber and protruding into the combustion chamber and of the walls of the combustion chamber at earth potential. In an engine with reciprocating pistons, the ignition electrode is preferably opposite to the respective piston. The energization of the resonant circuit is controlled in such a way that a corona discharge igniting the fuel-air-mixture is generated in the combustion chamber between the ignition electrode and the walls of the combustion chamber and that at the same time, a spark discharge taking place as a consequence of a complete voltage breakthrough between the ignition electrode and the walls of the combustion chamber is prevented.

According to the invention, the strength of the alternate current flowing in the resonant circuit, the alternate voltage energising the resonant circuit and/or the impedance of the resonant circuit are observed. Characteristic values specifying the state of the combustion chamber and/or the state of the mixture present in the combustion chamber are acquired from the observations or from one or several measured values derived therefrom and/or from their chronological sequence. These characteristic values are preferably entered into a diagnostic instrument and/or a control device, in particular an engine control device as input variables.

The invention has significant advantages:

The invention enables to draw conclusions from the behaviour of the resonant circuit on the state of the combustion chamber and on the state of the mixture present in the combustion chamber. The capacitance, which is formed by the combination of the ignition electrode and the walls of the combustion chamber, depends on the geometry and on the size of the combustion chamber and hence on the current position of the piston in the combustion chamber. The capacitance depends moreover on the medium situated in the combustion chamber and on its state. The capacitance depends in particular on the composition of the medium, on its temperature, on its density and hence on its pressure and on the quantity, type and configuration of the charge carriers present therein. This is quite important when (as in the present case) the fuel-air-mixture is to be ignited by a corona discharge.

With a piston engine operating cyclically, the parameters aforementioned which influence the capacitance do change during a working cycle in a characteristic fashion. Therefore insight can be gained into the piston movement and the sequence of the combustion process, the suction or charge process and the exhaust gas ejection process from the observation of the chronological development of the behaviour of the resonant circuit.

The variable capacitance directly provides information about changing states, which prevail in the combustion chamber and can therefore be used for monitoring and optimising the operation of the engine by observing the variable behavior of the resonant circuit, in particular the combustion process. To do so, the observation of the strength of the alternate current flowing in the resonant circuit, of the alternate voltage energising the resonant circuit and/or of the impedance of the resonant circuit enables to acquire characteristic values specifying the state of the combustion chamber and/or the state of the mixture present in the combustion chamber and to enter them for instance into an engine control device as input variables, which controls the engine accordingly in an open or closed loop.

For diagnostic purposes, limit values of states can be monitored and values exceeding or falling below limit values can be captured and/or displayed.

The invention enables to directly acquire states in the combustion chamber which otherwise cannot be captured in the engine or only at greater expense and with additional sensors, which cannot be accommodated in the combustion chamber or only with difficulty.

Since according to the invention states of the mixture present in the combustion chamber can be detected directly in the combustion chamber they can be detected without delay and hence enable very quick reactions of a control device, in particular of an engine control device. This facilitates optimisation of the ignition and of the combustion process in the engine.

The ignition electrode, which is used for detecting the states in the combustion chamber, is subject at most to minimal wear and is not prone to faults.

The invention can be used with any high-frequency ignition system which generates with a resonant circuit the strong electrical field required for a corona discharge, at the tip of an ignition electrode, which protrudes into the combustion chamber. The invention can be used in particular with an ignition system of the kind disclosed in document WO 2004/063560 A1. Such a system works with frequencies of typically 30 kHz to 3 MHz, comprises a series resonant circuit, of which the ignition electrode is an element, and energises the series resonant circuit with an alternate voltage of up to 5 kV and reaches an alternate voltage of up to 500 kV in the series resonant circuit through a voltage overshoot. In this an alternate voltage in the order of magnitude of 100 kV is preferred. Regarding the operating mode of such an ignition system, reference is made explicitly to the disclosure in document WO 2004/063560 A1.

For the purposes of the present invention, a frequency range of 500 kHz to 3 MHz is preferred, in particular of 500 kHz to 1.5 MHz. An output voltage of 0.1 kV to 5 kV is more suitably chosen, preferably a voltage of no more than 1 kV, for energising the resonant circuit.

It goes without saying that in addition to the capacitance formed in the combustion chamber, the resonant circuit also contains at least one inductance and may also contain another capacitance outside the combustion chamber if required. The resonant circuit can be connected to the output of a transformer via its inductance (winding). The transformer delivers the high frequency alternate voltage for energising the resonant circuit. The resonant circuit is preferably energised with its resonance frequency or with a frequency which is approximated to its resonance frequency. If the resonant circuit oscillates with its resonance frequency then the voltage increase occurring in the resonant circuit is the greatest.

Preferably, the phase shift between the alternate current flowing in the resonant circuit and the energising alternate voltage is observed for determining the resonance frequency of the resonant circuit. If the resonant circuit is a series resonant circuit, which is preferred according to the invention, then the frequency of the voltage energising it is regulated in such a way that the phase difference between the alternate current flowing in the resonant circuit and the energising voltage is minimised. Phase locked loops (PPL) which can do so, are known in the art. Such a phase locked loop enables to regulate the resonant circuit in such a way that the phase difference between the alternate current flowing in the resonant circuit and the energising alternate voltage is minimised.

The impedance of the resonant circuit can, as already disclosed in document WO 2004/063560 A1, be calculated from the mean of the amperage of the alternate current flowing in the resonant circuit and from the mean of the alternate voltage energising it. Therein both means are established for the same preset time span.

Another possibility is to determine the chronological progression of the impedance from the phase shift between the alternate current flowing in the resonant circuit and the alternate current flowing in the resonant circuit. It should be noted that the impedance correlates with the phase shift between current and voltage in the resonant circuit and reaches a minimum when current and voltage are in phase in the resonant circuit. This operating mode is preferred.

More appropriately, the impedance of the resonant circuit is adjusted to a set value by closed loop control. The set value is selected in such a way that a corona discharge takes place and can be preserved in the combustion chamber, without turning into a spark discharge or into an arc discharge. Instead of the impedance, the phase shift between current and voltage can also be adjusted to a set value by closed-loop control.

High frequency ignition devices, which turn into a spark discharge, are known per se. The transition of the corona discharge into a spark discharge generates a plasma, in which the electrical current flows comparatively unhindered with a strong voltage drop by forming an arc of light. In such a case, it is hardly possible to gain insight on the state of the mixture and of the combustion process in the combustion chamber, except determining the ignition timing and the breakthrough voltage. The purpose of the invention is hence to avoid a complete voltage breakthrough, but rather to preserve a corona discharge during which a charge cloud can develop in the region around the tip of the ignition electrode. The charge cloud predominantly consists of electrons, which are released in a volume with sufficiently high electrical field strength by field emission from the ignition electrode.

In the case of a combustion engine with reciprocating piston or rotary piston, the resonant circuit is preferably energised intermittently in a specified cycle, which depends on the piston movement and can be preset by the engine control device. The ignition timing can be derived from the clocking of the resonant circuit. In other cases, for instance with a drive turbine or with a gas burner, the resonant circuit can also be excited continuously and the corona discharge be preserved correspondingly continuously.

It has already been mentioned above that several influence factors come into play in the combustion space, which influence the behaviour of the resonant circuit by modifying the capacitance between the ignition electrode and the walls of the combustion chamber. These influence factors may, inasmuch as they have an effect on the behaviour of the resonant circuit in a characteristic fashion, be detected when the alternate current flowing in the resonant circuit, the alternate voltage energising it and/or the impedance of the resonant circuit and/or their chronological sequence are checked for characteristic features or patterns. This can happen for instance using an artificial neural network, because the recognition of such characteristic features or patterns can be learned. Another possibility consists in subjecting the chronological progression of the impedance of the resonant circuit to a wavelet transformation and to check for characteristic features or patterns in the transformed space. Once found, they may be interpreted numerically according to the frequency or intensity of their occurrence. Numerical values so acquired are entered into a diagnostic instrument and/or a control device as input variables. The diagnostic instrument can compare the numerical values entered therein with limit values and detect when said values exceed or fall below the limit values and/or display them. A control device can employ the input variables entered therein to exert influence on the control of the resonant circuit or on other actuators which are provided for the motor operation. The diagnostic instrument and the control device may be incorporated into a common apparatus along with various pieces of equipment for the ignition system, but they can also be realised separately or be incorporated into an engine control device which is present anyway.

The invention enables to acquire one or several characteristic values from the following group of characteristic values, which characterise the condition of the combustion chamber and/or the state of the mixture present in the combustion chamber, because they influence the electrical capacitance, which is formed by the combination of the ignition electrode and the walls of the combustion chamber, and hence the behaviour of the resonant circuit and its natural frequency:

The type and quality of the fuel, for instance a gasoline having a certain octane number.

The fuel to air mixing ratio. The dependence of the capacitance on this mixing ratio is favorable for the operation of low-pollutant lean engines.

The combustion pressure and its chronological progression. They give information about the dynamics of the combustion process.

The combustion position.

Any possible knocking of the combustion, which indicates an irregular sequence of the combustion process.

The piston position, because it immediately indicates the size of the combustion chamber, whose geometry and contents with its dielectric properties and the charge carriers contained therein influence the capacitance.

The synchronisation of the ignition timing with the piston movement.

The temperature of the combustion air and the pressure in the combustion air, because they determine the dielectric properties of the contents of the combustion chamber as well.

The function of actuators in the path of conveyed combustion air, that is to say a throttle and/or a turbo charger and/or an exhaust gas recirculation device, which influence the capacitance via a modification of the mixing ratio and of the pressure in the combustion chamber.

The characteristic values, which are acquired from the observation of the alternate current flowing in the resonant circuit, of the alternate voltage energising the resonant circuit and by observation of the impedance of the resonant circuit, are combined in an advantageous refinement of the invention with additional data, which are useful for controlling the combustion in the respective combustion chamber. The characteristic values can be used together with these additional data for controlling the combustion. This enables optimisation of the combustion, in particular with combustion engines in vehicles, which are usually fitted with an engine control device, in which an engine control computer ensures electronic engine management. To fulfil its open and closed loop control tasks, the engine control device usually receives data from sensors, which are arranged at different points in the vehicle, such as for instance a sensor for determining the engine speed, a sensor for the angular position of the crankshaft of the engine, a sensor for the angular position of the camshaft of the engine, a sensor for the angular position of a throttle of the engine, a sensor for measuring the external air pressure, a sensor for determining the sucked-in air mass flow, a sensor for measuring the temperature of the sucked-in air, a sensor for measuring the temperature of the cooling water in the engine, a sensor for measuring the temperature of the engine oil, a sensor for measuring the oil pressure in the engine, a sensor for measuring the fuel injection pressure, a knock sensor, a sensor for determining the position of the gas pedal, a tachometer.

In order to optimise the engine control for instance in terms of low fuel consumption and low pollutant emission, the characteristic values acquired from the observation of the resonant circuit can be associated, interpreted in common and processed with the additional data entered into the engine control device.

A system for igniting the fuel-air-mixture in a combustion chamber is disclosed herein. It mainly consists of a voltage source, for instance a battery or an accumulator, from which a high frequency alternate voltage is generated by means of a high-frequency generator, which energises an electrical resonant circuit, in which a capacitance is present, which is formed by the combination of an ignition electrode with the walls of the combustion chamber at earth potential. A control device controls the energization of the resonant circuit in such a way that a corona discharge is generated in the combustion chamber in the environment of the ignition electrode while a spark discharge is avoided. According to the invention, the system includes means for observing the alternate current flowing in the resonant circuit, means for observing the alternate voltage energizing the resonant circuit and/or means for observing the impedance of the resonant circuit. The system also comprises an analyzing circuit, which acquires characteristic values specifying the state of the combustion chamber and/or the state of the mixture present in the combustion chamber from the observations and/or from one or several measured values derived therefrom and/or from their chronological sequence. These characteristic values are made available on an interface for further processing. They can be transmitted via the interface to a control device of the ignition system, where they can be used to control the actual ignition process. But they can also be transmitted to a diagnostic instrument via the interface, in which device they can be used to carry out a diagnostic of the ignition system. To do so, certain characteristic values are monitored for the observance of limit values and values exceeding or falling below limit values are stored in memory and/or displayed. Limit values stored in memory can be read in a workshop with a diagnostic computer present therein. A control device can also be connected to the interface, in particular an engine control device, into which the characteristic values are entered as input variables for assisting in the engine control. For example, the composition of the ignitable fuel-air mixture for a determined fuel type, the ignition timing and the duration of the corona discharge per engine cycle can thus be acquired using input variables, which were derived from the observation of the behaviour of the resonant circuit.

The accompanying schematic drawings below provide better explanation of the invention.

DETAILED DESCRIPTION

Figure 1:
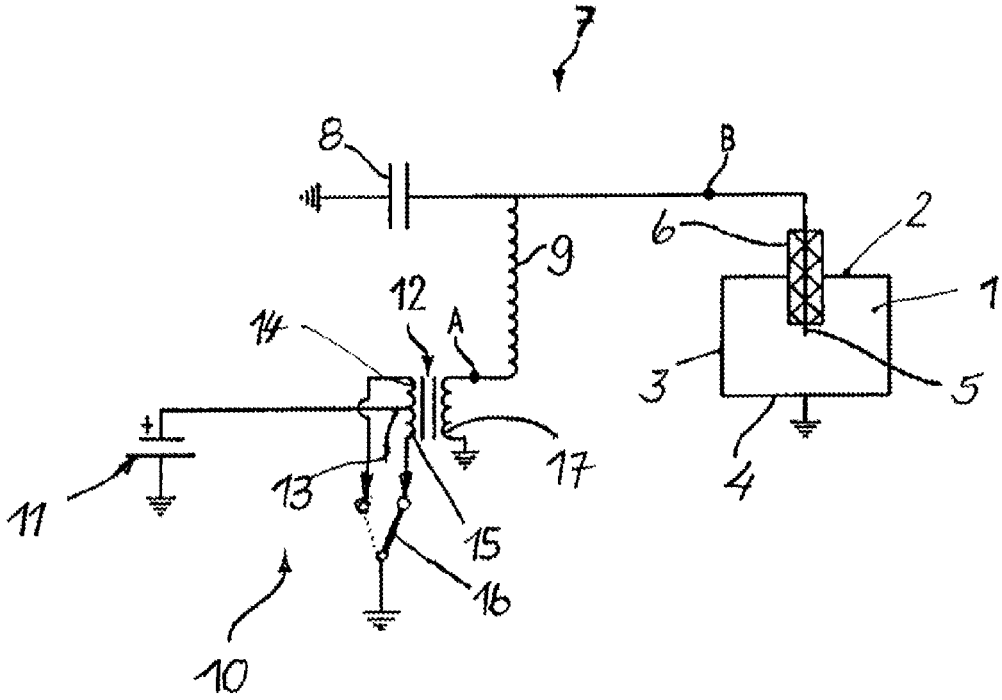
FIG. 1 shows schematically the assembly of an ignition system for a motor for a vehicle.

FIG. 1 shows a combustion chamber 1, which is delineated by walls 2, 3 and 4, which are at ground potential. An ignition electrode 5 protrudes from above into the combustion chamber 1, which electrode is surrounded by an insulator 6 on a portion of its length, with which it runs through the top wall 2 into the combustion chamber 1 with an electrical insulation. The ignition electrode 5 and the walls 2 to 4 of the combustion chamber 1 are part of a series resonant circuit 7, which also comprises a capacitor 8 and an inductance 9. It goes without saying that the series resonant circuit 7 can include additional inductances and/or capacitances and various constitutive elements, which are well-known to those skilled in the art as possible components of series circuits.

A high-frequency generator 10 is provided for energising the resonant circuit 7. This generator has a D.C. voltage source 11 and a transformer 12 with a centre tap 13 on its primary side, wherein two primary windings 14 and 15 meet on the centre tap 13. The ends of the primary windings 14 and 15, which are remote from the centre tap 13, are connected to earth alternately by means of a high frequency change-over switch 16. The switching frequency of the high frequency change-over switch 16 determines the frequency, with which the series resonant circuit 7 is energised, and can be modified. The secondary winding 17 of the transformer 12 feeds the series resonant circuit 7 on point A. The high frequency change-over switch 16 is operated by means of a non-illustrated closed loop control circuit in such a way that the resonant circuit is energised with its resonance frequency. The voltage between the tip of the ignition electrode 5 and the walls 2 to 4 at earth potential is then the greatest.

The impedance of the series resonant circuit 7 determines the nature of the electrical discharge occurring on the ignition electrode. The impedance is controlled on a set value by means of a closed loop controller which is not shown. The set value is to be reached, so that a corona discharge occurs and can be preserved for a preset time span to trigger an ignition of the fuel-air mixture in the combustion chamber 1, but the set value should not be exceeded, so that no voltage breakthrough and as a further consequence no spark discharge or arc discharge takes place in the combustion chamber 1. To be able to regulate the impedance of the resonant circuit 7 to its setpoint value, its actual value has to be determined. The actual value of the impedance is preferably determined from the simultaneous measurement of current and voltage on the transformer 12, namely on the secondary of the transformer 12.

Figure 2:
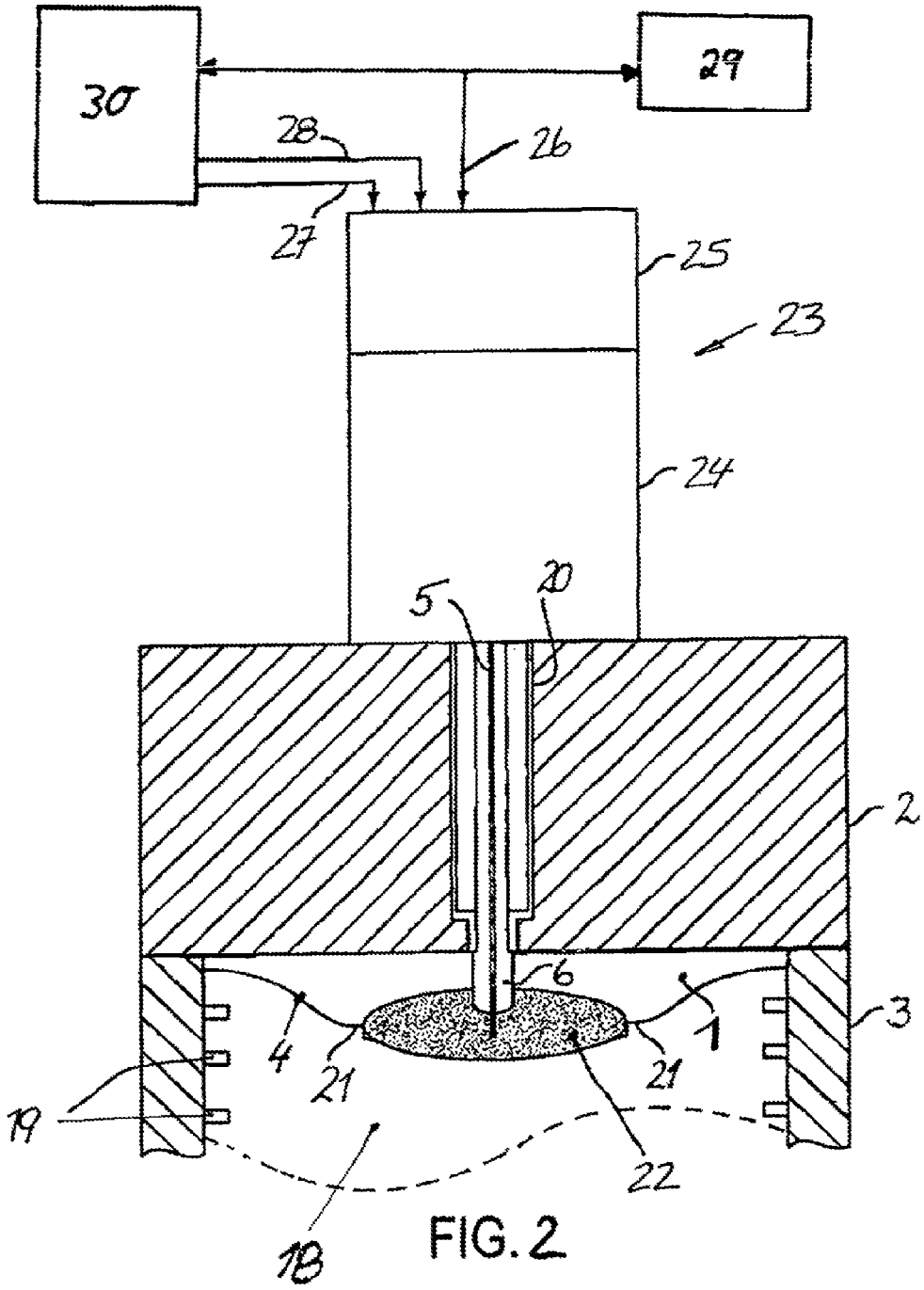
FIG. 2 shows a longitudinal section through a cylinder of a combustion engine, which is associated with the ignition system illustrated in FIG. 1.

FIG. 2 shows a longitudinal section through a cylinder of a combustion engine, which is equipped with the ignition device illustrated schematically in FIG. 1. The combustion chamber 1 is delineated by a top wall 2 designed as a cylinder head, by a cylindrical peripheral wall 3 and by the upper side 4 of a piston 18 moving back and forth in the cylinder, which is provided with piston rings 19.

In the cylinder head 2 is a passage 20, through which the ignition electrode 5 is passed electrically insulated and in a sealed fashion. The ignition electrode 5 is surrounded by an insulator 6 on a portion of its length. The insulator may consist of a sintered ceramic, for instance of an aluminium oxide ceramic. The ignition electrode 5 reaches into the combustion chamber 1 with its tip and protrudes a little over the insulator 6, but could also be flush with the same.

A few sharp-edged protrusions 21 can be provided on the upper side of the piston 18 in the vicinity of the tip of the ignition electrode 5, which are used for locally increasing the electrical field strength between the ignition electrode 5 and the piston 18 opposite thereto. A corona discharge forms when energising the resonant circuit 7 mostly in the region between the ignition electrode 5 and the selectively present protrusions 21 of the piston 18 which can be accompanied by a more or less intensive charge carrier cloud 22.

A housing 23 is attached on the external face of the cylinder head 2. The primary windings 14 and 15 of the transformer 12 and the high frequency switch 16 co-operating therewith are situated in a first compartment 24 of the housing 23. The secondary winding 17 of the transformer 12 and the remaining components of the series resonant circuit 7 as well as means for observing the behaviour of the resonant circuit 7 are situated in a second compartment 25 of the housing 23. These means transmit the results of their observations to an analysing circuit in the second section 25. Said circuit determines characteristic values therefrom, which characterise the state of the combustion chamber 1 and/or of the gaseous mixture present in the combustion chamber and makes them available at an interface 26, via which they can for instance reach a diagnostic instrument 29 and/or an engine control device 30, which uses them as input variables for control and regulation tasks for the purposes of controlling the engine. The engine control device transfers timing signals to an input 27 and other control signals, for example reference set for the impedance of the resonant circuit 7, to an input 28 of the ignition device.

APPENDIX

WO 2004/063560 A1

LIST OF REFERENCE NUMBERS

1. Combustion chamber
2. Wall of the combustion chamber
3. Wall of the combustion chamber
4. Wall of the combustion chamber, upper side of the piston 18
5. Ignition electrode
6. Insulator
7. Resonant circuit, series resonant circuit
8. Capacitor
9. Inductance
10. high-frequency generator
11. D.C. voltage source
12. Transformer
13. Centre tap
14. Primary winding
15. Primary winding
16. High frequency change-over switch
17. Secondary winding
18. Piston
19. Piston rings
20. Passage
21. Protrusions
22. Charge carrier cloud

23. Housing
24. First section of 23
25. Second section of 23
26. Interface
27. Input
28. Input
29. Diagnostic instrument
30. Engine control device

The invention claimed is:

1. A method for igniting a fuel-air-mixture in one or more combustion chambers, which are limited by walls that are at earth potential, the method comprising:

energizing an electrical resonant circuit, in which an electrically insulated ignition electrode extending through one of the walls of the combustion chamber and protruding into the combustion chamber forms a capacitance in conjunction with the walls of the combustion chamber at earth potential;

controlling the energization of the resonant circuit in such a way that a corona discharge igniting the fuel-air-mixture is generated in the combustion chamber on the ignition electrode;

monitoring a strength of either an alternating current flowing in the resonant circuit, an alternating voltage energizing the resonant circuit and/or an impedance of the resonant circuit; and acquiring characteristic values specifying the state of the combustion chamber and/or the state of the mixture present in the combustion chamber from the observations or from the strength of either the alternating current, the alternating voltage or the impedance of the resonant circuit and/or from their chronological progression and which characteristic values are provided for further processing.

2. The method of claim 1, used in combination with a combustion engine, in particular in a piston engine, with one or several combustion chambers.

3. The method of claim 2, wherein the acquired characteristic values are entered into a diagnostic instrument and/or an engine control device as input variables.

4. The method according to claim 1 wherein the resonant circuit is energized with its resonance frequency or with a frequency, which is approximated to its resonance frequency.

5. The method according to claim 1 wherein a phase shift between the alternating current flowing in the resonant circuit and the energizing alternating voltage is observed for determining the resonance frequency of the resonant circuit.

6. The method of claim 5, wherein the frequency of the alternating voltage energizing the resonant circuit is regulated by closed loop control in such a way, that the phase difference between current and voltage in the resonant circuit adopts a set value.

7. The method according to claim 5 wherein the resonant circuit is a series resonant circuit and the frequency of the alternating voltage energizing it is regulated by closed loop control in such a way, that the phase difference between the alternating current flowing in the resonant circuit and the energizing voltage is minimized.

8. The method according to claim 1 wherein the impedance of the resonant circuit is calculated from the mean of the amperage of the alternating current flowing in the resonant circuit and from the mean of the alternating voltage energizing it, both means being established for the same preset time span.

9. The method according to claim 1 wherein the impedance of the resonant circuit is determined from the phase shift between the alternate current flowing in the resonant circuit and the alternate voltage energizing the resonant circuit.

10. The method according to claim 8 wherein the impedance of the resonant circuit is regulated by closed loop control on a set value which is selected in such a way that a corona discharge takes place and can be preserved in the combustion chamber without turning into a spark discharge.

11. The method according to claim 1 wherein the resonant circuit is intermittently energized in a preset cycle.

12. The method of claim 11, wherein the cycle is preset by an engine control device.

13. The method according to claim 1 wherein the alternating current flowing in the resonant circuit, the alternate voltage energizing the resonant circuit and/or the impedance of the resonant circuit and/or their chronological progression are checked for characteristic features or patterns, that the characteristic features or pattern thus found are interpreted numerically and that the numerical values so acquired are entered into a diagnostic instrument and/or a control device, in particular an engine control device, as input variables.

14. The method of claim 13, wherein the search for characteristic features and pattern involves an artificial neural network and/or a wavelet transformation, which is applied to the chronological sequence of the impedance of the resonant circuit.

15. The method according to claim 1 wherein one or several characteristic values are acquired from the following group of characteristic values, which characterize the state of the combustion chamber and/or the state of the mixture present in the combustion chamber: the type and quality of the fuel, the fuel to air mixing ratio, the combustion pressure and its chronological sequence, the combustion position, any possible knocking of the combustion, the piston position, the synchronization of the ignition timing with the piston movement, the temperature of the combustion air, the pressure in the combustion air, the function of the actuators in the path of the conveyed combustion air (throttle, turbo charger, exhaust gas recirculation).

16. The method according to claim 1 wherein the acquired characteristic values are used for engine diagnostic and/or engine control purposes.

17. The method according to claim 1 wherein the characteristic values, which are acquired from the observation of the alternating current flowing in the resonant circuit, the alternating voltage energizing the resonant circuit and/or the impedance of the resonant circuit, are combined with additional data, which are useful for controlling the combustion in the respective combustion chamber and used together with the characteristic values for controlling the combustion.

18. The method of claim 3 wherein the characteristic values and the additional data are combined in the engine control device and processed together in said control device for the purposes of engine control as well as for controlling the energization of the resonant circuit.

19. The system for igniting a fuel-air-mixture in a combustion engine by a method according to one of the previous claims, with one or several combustion chambers, which are limited by walls that are at earth potential, wherein an electrical resonant circuit is energized with an electrical high-frequency generator, in which an ignition electrode extending electrically insulated through one of the walls of the combustion chamber and protruding into the combustion chamber forms a capacitance in conjunction with the walls of the combustion chamber at earth potential, and wherein a control device is provided, which controls the energization of the resonant circuit in such a way that a corona discharge igniting the fuel-air-mixture is generated in the combustion chamber by avoiding a spark discharge between the ignition electrode and the walls of the combustion chamber, wherein means for observing the alternating current flowing in the resonant circuit, means for observing the alternating voltage energizing the resonant circuit and/or means for observing the impedance of the resonant circuit, and an analysing circuit, which generates characteristic values specifying the state of the combustion chamber and/or the state of the mixture present in the combustion chamber from the observations and/or from one or several measured values derived therefrom and/or from their chronological progression and keeps them ready for further processing on an interface.

20. The system of claim 19, wherein a diagnostic instrument and/or a control device, in particular an engine control device, is connected to the interface to which the characteristic values are provided by the analyzing circuit as input variables.

21. The system of claim 19 wherein the analyzing circuit contains an artificial neural network.

22. The system of claim 19 wherein the analyzing circuit applies a wavelet transformation to the chronological sequence of the impedance of the resonant circuit.

* * * * *